United States Patent [19]

Bond

[11] Patent Number: 4,576,350

[45] Date of Patent: Mar. 18, 1986

[54] PORTABLE BAG FILLING STAND

[76] Inventor: James Bond, 527 W. South St., Anaheim, Calif. 92805

[21] Appl. No.: 613,738

[22] Filed: May 24, 1984

[51] Int. Cl.[4] ..... B65B 67/12

[52] U.S. Cl. ..... 248/97; 248/100

[58] Field of Search ..... 248/95, 97–101

[56] References Cited

U.S. PATENT DOCUMENTS

| | | | |
|---|---|---|---|
| 1,055,745 | 3/1913 | Harrison | 248/97 |
| 1,225,866 | 5/1917 | Schrears | 248/97 |
| 1,350,443 | 8/1920 | Edstrom | 248/97 |
| 1,542,164 | 6/1925 | Nelson | 248/97 |
| 1,956,986 | 5/1934 | Hetherington | 248/99 |
| 2,423,325 | 7/1947 | Jones | 248/100 |
| 2,451,829 | 10/1948 | Hightower | 248/100 |
| 3,866,872 | 2/1975 | Burgess | 248/97 |

*Primary Examiner*—Reinaldo P. Machado
*Assistant Examiner*—Alvin Chin-Shue
*Attorney, Agent, or Firm*—Natan Epstein

[57] ABSTRACT

A multi-bag supporting stand useful for efficient sand bagging operations has a base, a vertical support extending from said base, and a dual bag holder frame slideable along the vertical support for adjusting the height of the bag support frame for differently dimensioned bags. In one embodiment, the dual bag holder is expandable to a quadruple bag holder by attachment of single bag holder modules. Both the dual and single bag holders are adjustable for different bag widths, and each includes bag supporting hooks from which bags may be hung.

18 Claims, 2 Drawing Figures

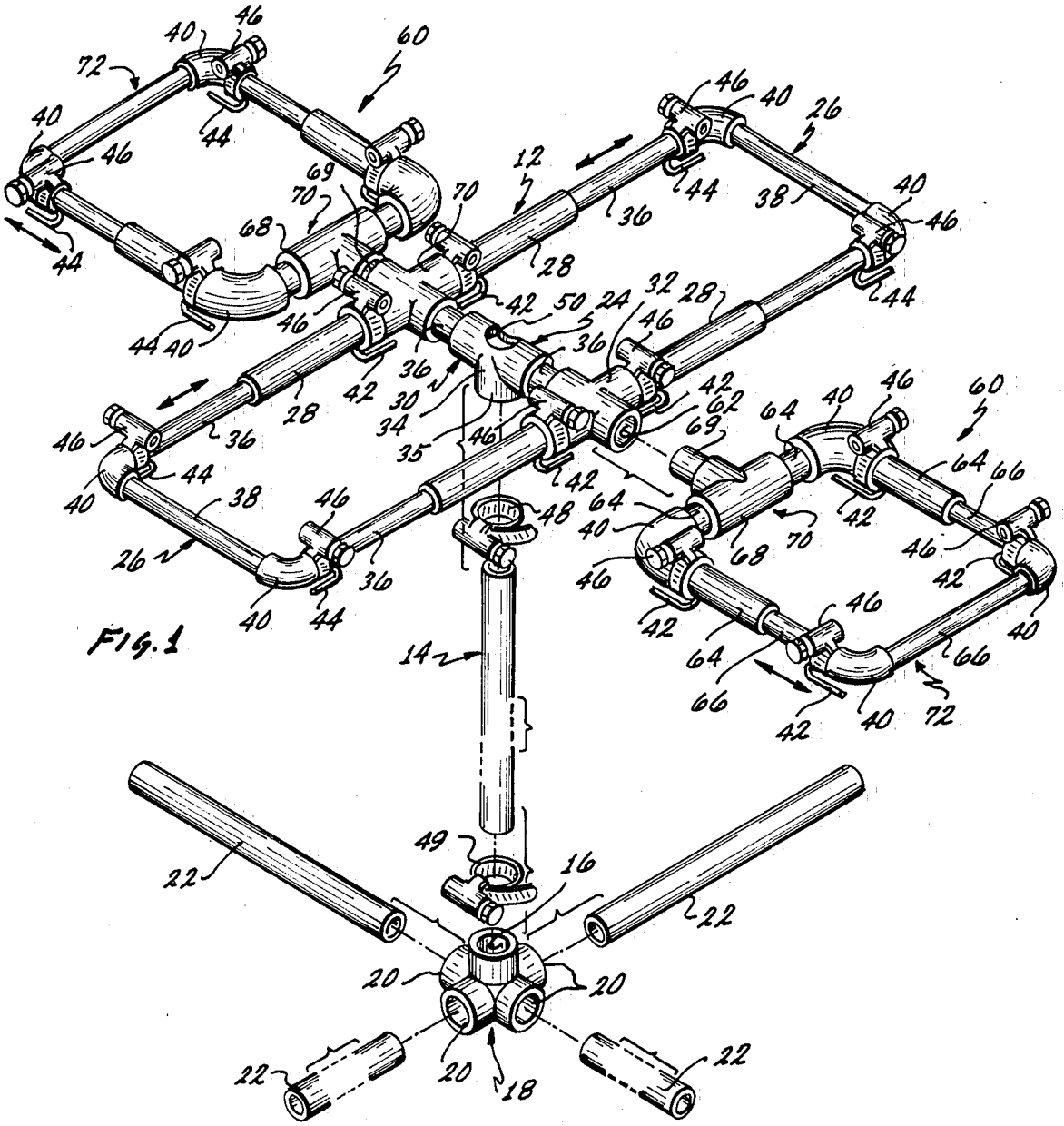
Fig. 1
Fig. 2
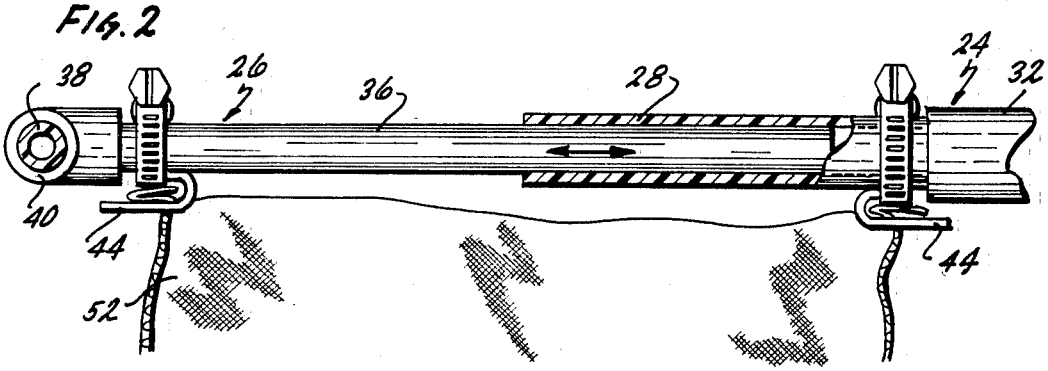

PORTABLE BAG FILLING STAND

BACKGROUND OF THE INVENTION

1. Field of the Invention

The present invention pertains generally to the field of sack or bag holders useful for supporting a bag while it is being filled and, more particularly, is directed to an improved, easily adjustable portable multi-bag filling stand particularly useful for sand bagging operations and which is readily disassembled for compact storage and transport.

2. STATE OF THE PRIOR ART

Bag holders of many designs are known in the art, as exemplified by the following patents:

| U.S. Pat. No. | Patentee |
|---|---|
| 203,891 | Joseph Lanham Conway |
| 2,423,325 | Jack J. Jones |
| 1,015,621 | Louis Hanson |
| 1,542,164 | Swan Nelson |
| 641,055 | James Thompson |
| 564,143 | W. H. Boyd |
| 4,304,378 | Earl C. Briggs |
| 2,966,290 | M. J. DeAngelis |
| 1,700,717 | S. Piombo |
| 1,240,852 | P. Israelson |
| 2,448,821 | J. E. Murphy |
| 645,595 | J. L. Herr |
| 4,312,489 | W. F. Paetzold |
| 3,866,872 | L. E. Burgess |
| 922,624 | Laurits Pedersen |
| 94,283 | J. N. Collins |
| 2,995,329 | Louie R. Talcott, Jr. |
| 1,121,388 | R. K. Milks |
| 630,684 | Harrison C. Goldsmith |
| 885,680 | C. Thoen |

None of the bagging stands known to applicant provides a stand which is suitable for supporting in a readily detachable manner multiple bags simultaneously, which is conveniently adjustable in height and width for different sized bags and which can also be readily disassembled for compact storage and easy transport.

In particular, none of the bag holders presently known are suitable for use in sand-bagging operations by civil authorities in emergency situations such as flooding, or by the military. In both cases, there exists a need for a bag filling stand which is readily transportable to remote locations and which can also be conveniently stored between uses in the field. The stand must be sturdy, reliable, largely impervious to damage by impact or the elements, easily adjustable to different sized sand bags, and of economical construction.

Most importantly, the bag holder should be capable of supporting multiple bags simultaneously in order to maximize the efficiency of the sand bagging operation. At present, sand bagging requires two individuals, one holding open the sack or bag while the second person shovels sand or dirt into the bag. The personnel requirements can be cut in half if the bag is supported by means of a stand, releasing one person from the task. Thus, a single individual can attach the bag to the stand, fill the bag and remove it from the stand. The efficiency of the sand bagging procedure may be even further increased by providing a stand which is capable of supporting at least two and preferably more bags simultaneously. This reduces the frequency with which the operator must interrupt the shoveling process in order to attach empty bags or disengage filled bags from the stand, thus speeding up the sand bagging operation on occasions when time is of the essence and human lives, dwellings and property may depend on the speed with which the sand bagging operation is carried out.

No suitable multi-bag stand is known to this applicant which meets these requirements.

SUMMARY OF THE INVENTION

The present invention overcomes the shortcomings of the prior art by providing a bag filling stand which is a basic two-bag version has a base, a vertical support removably attached to the base, a unitary dual bag support frame comprising an H-shaped portion mounted to the vertical support, and a pair of U-shaped slides telescopically slidable into and out of the H-shaped portion so as to define two rectangles of variable dimension. Hooks are attached both to the undersides of the H portion and each of the U slides to provide four hooks on each side of the crossbar of the H portion so that a bag may be hung on each side of the crossbar.

The dual bag support frame detaches as a single unit from the vertical support, while the latter is detachable from the base. In a presently preferred embodiment the base consists of a multi-socketed base connector detachable from the lower end of the vertical support and provided with sockets for detachably receiving three or more horizontally extending legs. In an alternate embodiment the base may be planar sheet provided with attachment means for securing the dual bag holder unit and the vertical support flat against the base such that all components of the stand may be stored together as a compact unit without risk of losing any of the components.

In an expandable embodiment of the basic dual bag stand, sockets are provided at the ends of the crossbar of the H portion of the dual bag holder unit for accepting additional single bag holder modules at each end of the crossbar. The single bag holder units may each consist of a pair of telescoping U-shaped sections forming a rectangle of variable length, one of the U sections including a fitting mateable to one of the sockets on the crossbar. By providing two such additional single bag holder units, one at each end of the crossbar, a modular quadruple bag filling stand may be constructed which can be quickly and easily assembled and disassembled and simultaneously adjusted in height for all four bags. All four bags are suspended at a common height on the stand, thus facilitating the filling process.

Each of the U sections of the single bag holder units is provided with a pair of hanging hooks such that a bag may be supported at four points from the single holder unit, and the holder unit may be quickly adjusted to open the mouth of the bag for filling by simply telescoping apart the two U sections. The U slides on the dual bag spreader unit may be similarly adjusted for holding open the bags suspended therefrom.

BRIEF DESCRIPTION OF THE DRAWINGS

FIG. 1 is a partly exploded perspective view of a modular multiple bag-filling stand convertible between a dual bag and a quad-bag configuration.

FIG. 2 is a sectional view illustrating the telescoping assembly of a bag support unit and the mounting of hooks thereto by means of hose clamps.

DETAILED DESCRIPTION OF THE INVENTION

With reference to the drawings, and FIG. 1 in particular, a bag filling stand 10 includes a dual bag holder frame 12 supported at the upper end of a vertical tubular support 14. The lower end of the vertical support 14 is fitted into upwardly facing socket 16 of a central five-way base connector hub 18. The connector 18 has four additional sockets 20 which are adapted for receiving four legs 22 which extend orthogonally to each other and also to the vertical support 14. The four legs 22 are preferably co-planar and together define a base for the bag filling stand.

The dual bag holder unit 12 includes a central H-shaped portion 24 and a pair of U-shaped slider units 26. The H-shaped portion may be said to include four tubular arms 28 and a crossbar 30. In a presently preferred embodiment, the crossbar 30 includes a pair of end connectors 32 and a center connector 34 connected to the end connectors by short lengths of tubing 36. In a basic, no-expandable dual bag stand each end connector 32 may be a T connector having fitted to it a pair of axially aligned arms 28 and a short length of tubing 36.

The slider units 26 each consist of two parallel lengths 36 of tubing or rod joined at one end by a transverse member 38 which is connected to the parallel members 36 by means of elbow fittings 40. The parallel members 36 have an outer diameter which fits snugly into the arms 28 as best seen in the sectional view of FIG. 2.

Each arm 28 of the H portion has affixed to its underside a bag supporting hook 42, the end of which faces towards the crossbar 30. Each of the parallel members 36 of the slides 26 also has a bag supporting hook 44 attached to it, the ends of the hooks facing away from the crossbar 30. A presently preferred method of mounting the hooks to the respective supporting members is by means of commercially available hose clamps 46. The hose clamps preferably are of the type which are adjustable in diameter by means of a screw so that the position of the hooks along their respective supporting members is readily adjustable by loosening and sliding the clamp along the supporting member. The hooks may be bent lengths of stiff wire welded to the underside of the clamps or, in the alternative, may be simply held captive between the supporting tube or rod and the clamp ring when the clamp is tightened. In the latter case, the hooks may be easily removed from the frame assembly by loosening the clamps so that the hooks may be stored separately to avoid injury to personnel handling the device during storage or transport. The hooks are easily reinstalled when the stand is assembled in the field.

The center connector 34 may be a T connector and has a top opening 50 dimensioned and positioned so that the vertical support tube 14 can slide through the connector 34, so that the frame 12 can be positioned at any point along the vertical tube 14 and secured at a selected point therealong by means of a clamp 48 mounted to the downwardly facing socket 35 of the center fitting 34. This downwardly oriented socket is desirably slotted in a diametric plane such that the two resulting cylindrical halves of the socket may be compressed by the clamp 48 and tightened around the tube 14 to thereby lock the frame 12 in place. Similar means are used at the lower end of the vertical tube 14 to secure the tube to the upwardly oriented socket 16 of the base connector 18. The dual bag support frame 12 is thus readily detached from the vertical support 14 by loosening clamp 48 and sliding the center connector 34 off of the tube 14. The tube 14 in turn is detached from the base connector 18 by loosening clamp 49. The radially extending legs 22 may be held in their respective sockets 20 by friction fit alone, and are thus readily detached from the connector. It will be appreciated that the bag filling stand may thus be quickly and easily disassembled by detaching the legs 22 from the base connector 18 and detaching the frame 12 from the vertical support 14. The separate pieces can be placed in a bag for compact storage and transport.

The stand 10 is just as easily assembled for field use by slipping the center fitting 34 of the frame 12 onto the vertical support 14 and attaching the legs 22 to the base fitting 18, and tightening clamps 48 and 49. Two bags (not shown) may be hung from the frame 12, one on each side of the crossbar 30 from the four hooks provided on each side of the crossbar. In FIG. 2 one side of a bag 52 partially shown in section, is seen hung from hooks 44, one hook being on the stationary H portion of the frame 12, while the other hook 44 is attached to the slide 26. The spacing between the two hooks 44 is easily adjusted for the width of a particular bag 52 by telescoping the slide 26 into or out of the arms 28 of the H portion 24. The slide 26 may be slid into the H portion also for easy attachment of the bag to the hooks 44, and then slid outwardly from the H portion to stretch open the mouth of the bag 44. The height of the frame 12 relative to the base is adjusted for the length of a particular bag by sliding the center fitting 34 along the vertical tube 14 to a point at which the bottom of the bag rests on the ground. Thus as dirt is shoveled through the two open inner rectangular spaces defined by the frame 12, the dirt at the bottom of the bag is supported by the ground surface and does not weigh from the frame 12. The frame is therefore relied upon only for keeping the mouth of the bag open and upright while it is filled. To the extent that any forces are imposed on the frame by two bags suspended therefrom, such forces are substantially balanced out by the symmetrical arrangement of the bags on each side of the center support so that the overall stand remains stable. As a result, it is possible to construct the stand 10 from lightweight materials such as commonly available PVC (polyvinyl chloride) tubing and fittings used for low cost plumbing systems.

A basic dual bag stand may be explained to a quadruple bag stand by adding a pair of single bag holder modules or units 60 to the basic dual bag holder unit 12 already described.

In such an expandable stand, the end fittings 32 of the H portion 24 ay be X connectors such that an outwardly facing socket 62 is provided at each end of the crossbar 30. Each single bag support unit 60 consists of two mutually telescopable U-shaped portions formed out of straight lengths of tubing 64 joined by elbow fittings 40, one of the U portions including a T fitting 68 which has a male portion 69 mateable to the socket 62 at the end of the crossbar 30. Each of the single bag units comprises a first U section 70 which includes the T fitting 68 and is made out of lengths of tubing 64 joined by elbows 40, and a second U section 72 made of relatively thinner tubing or rod sections 66 which are telescopically slidable within the larger tubing 64 of the first U section such that the two U sections 70 and 72 may be telescoped together or apart to vary the area of the rectangle defined by the unit 60. Each of the U sections 70, 72 is provided with a pair of hooks 42, the hooks of each U section facing away from the hooks of the other section of the unit 60. A bag may be hung from each bag holder unit 60 by piercing material or fabric of the bag with the hooks at four spaced apart points about the mouth of the bag. The hooks 42 may be held to the tubing of the bag holders 60 by means of hose clamps 46 in a manner analogous to that described in connection the dual bag holder frame 12.

A dual bag filling stand may thus be quickly and easily converted to a quad bag filling stand by simply fitting the two single bag holder units 60 to sockets 62 of the crossbar 30. Four bags may be thus supported in a balanced symmetrical arrangement which allows the use of relatively lightweight materials for the stand, and also enables quick and easy height adjustment of the supporting frame assembly 12 by sliding along the vertical support 14, to thereby simultaneously adjust the height of all four bags on the stand.

The stand in both its dual and quadruple bag configurations may be constructed of heavier materials, such as metal tubing of either circular or rectangular cross sections. The tubing may be welded together for more secure and durable construction.

In either case, the tubular base assembly shown in FIG. 1 may be replaced by a solid sheet or equivalent base, such as a sheet of steel or heavy plastic. Such a unitary base may further be provided with clips or other means for retaining the vertical support 14, the dual bag frame unit 12, as well as, if desired, the single bag units 60 against the frame in disassembled condition for easy compact storage without danger of misplacing or losing any of the component parts. Suitable clips or other fasteners for accomplishing this purpose will be apparent to those skilled in the art.

While a particular embodiment of the invention has been described and illustrated, it will be understood that many changes, alterations and substitutions may be made without departing from the spirit and scope of the invention as defined by the following claims.

What is claimed is:

1. A low cost light-weight portable dual bag filling stand adapted to quick field assembly and easy disassembly for compact transport and storage comprising:

a single vertical support tube having an upper end and a lower end;

a first fitting at said lower end for movably accepting a plurality of co-planar tubular legs in perpendicular relationship to said vertical support to thereby define a base; and a dual bag support frame on said vertical support, said frame comprising a tubular cross-member having opposite ends and including a central fitting slidable along said vertical support for selectively positioning said frame therealong and an end fitting at each said end, each end fitting accepting two tubular arms perpendicular to said cross-member to thereby form a horizontally planar H-shaped structure, a U-shaped section telescopically slidable into each pair of arms of said H-shaped structure to form two bag supports of independently adjustable aperture and provided with hook means for suspending a bag on each side of said cross-member thereby imposing a balanced load on the single vertical support.

2. The bag filling stand of claim 1 wherein said first fitting includes a socket for removably receiving said vertical support and further sockets for receiving at least three of said tubular legs.

3. The bag filling stand of claim 2 wherein said legs are straight lengths of tubing.

4. The bag filling stand of claim 2 wherein said legs and said vertical support are straight lengths of tubing.

5. The bag filling stand of claim 4 wherein said first fitting is a five-way pipe connector for connecting four orthogonally disposed coplanar tubular legs to said vertical support tube perpendicular to the plane of said legs.

6. The filling stand of claim 5 further comprising second clamp means for detachably securing said vertical support tube to said five-way connector.

7. The bag filling stand of claim 1 wherein said H-shaped portion is an assembly of plumbing fittings wherein said end fittings are first and second T-connectors said first and second T-connectors each accepting two straight lengths of tubing to form the arms of the H portion, said center fitting being a third T-connector oriented and adapted for accepting the upper end of said vertical support at a right angle to the plance defined by said H portion.

8. The bag filling stand of claim 7 wherein said vertical support is a tube slidable fully through said center fitting such that the H-shaped portion may be positioned at any desired height along said vertical support relative to said base.

9. The bag filling stand of claim 8 further comprising clamp means for releasably fixing said center fitting to said vertical support.

10. The bag filling stand of claim 7 wherein each said U-shaped slide comprises two parallel lengths of tubing and a transverse length of tubing joined to the parallel lengths by means of elbow fittings.

11. The bag filling stand of claim 7 wherein all of said fittings and lengths of tubing are made of commercially available PVC plumbing stock.

12. The bag filling stand of claim 1 wherein said hook means comprise lengths of wire bent to a hook shape and secured to said H portion and each of said U-shaped slides by means of detachable clamps.

13. The bag filling stand of claim 12 wherein said clamps securing said lengths of wire are hose clamps.

14. The bag filling stand of claim 1 wherein said end fittings are X fittings, one socket in each X fitting remaining free to accept additional detachable single bag support modules.

15. The bag filling stand of claim 14 wherein all of said fittings and lengths of tubing are made of commercially available PVC plumbing stock.

16. The stand of claim 1 wherein each of said end fittings includes an end socket adapted to receive a mating fitting on a detachable single bag holder module, whereby said dual bag stand is readily field-convertible to a quadruple bag stand.

17. The stand of claim 16 further comprising two single bag holder modules each comprising two mutually telescoping U-shaped sections forming a rectangle of variable length, one of said U-sections including a fitting mateable to one of said end sockets on the cross-member.

18. A low-cost light-weight portable modular multi-bag filling stand adapted to quick field assembly and easy disassembly for compact transport and storage comprising:

a single vertical support tube having an upper end and a lower end;

a first fitting at said lower end for removably accepting a plurality of co-planar tubular legs in perpendicular relationship to said vertical support to thereby define a base;

a dual bag support frame on said vertical support, said frame comprising a tubular cross-member having opposite ends and including a central fitting slidable along said vertical support for selectively positioning said frame therealong and an end fitting at each said end, each end fitting accepting two tubular arms perpendicular to said cross-member to thereby form a horizontally planar H-shaped structure, a U-shaped section telescopically slidable into each pair of arms of said H-shaped structure form two bag supports of independently adjustable dimensions and provided with hook means for suspending a bag on each side of said cross-member thereby imposing a balanced load on the single vertical support;

each of said end fittings including an end socket adapted to receive a mating fitting on a detachable single bag holder module; and two single bag holder modules each comprising two mutually telescoping U-shaped sections forming a rectangle of variable length, one of said U-sections including a fitting mateable to one of said end sockets on the cross-member;

whereby said bag stand is readily field-convertible between a dual and a quadruple bag stand while maintaining a balanced load on said single vertical support in either dual or quad configurations.

* * * * *